US006443663B1

(12) United States Patent
Scales et al.

(10) Patent No.: US 6,443,663 B1
(45) **Date of Patent: *Sep. 3, 2002**

(54) SELF-LOCKING CLAMP FOR ENGAGING SOIL-REINFORCING SHEET IN EARTH RETAINING WALL AND METHOD

(75) Inventors: John M. Scales, Norcross; Zehong Yuan Pe, Duluth, both of GA (US)

(73) Assignee: Geostar Corp., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/698,004

(22) Filed: Oct. 25, 2000

(51) Int. Cl.[7] ..... E02D 29/02
(52) U.S. Cl. ..... 405/262; 405/284; 405/286
(58) Field of Search ..... 405/262, 284, 405/285, 286

(56) References Cited

U.S. PATENT DOCUMENTS

| | | | | | |
|---|---|---|---|---|---|
| 3,383,864 | A | | 5/1968 | Turzillo | 61/38 |
| 3,686,873 | A | | 8/1972 | Vidal | 61/39 |
| 4,116,010 | A | | 9/1978 | Vidal | 405/262 |
| 4,324,508 | A | | 4/1982 | Hilfiker et al. | 405/284 |
| 4,448,571 | A | | 5/1984 | Eckels | 405/284 |
| 4,661,023 | A | | 4/1987 | Hilfiker | 405/262 |
| 4,710,062 | A | | 12/1987 | Vidal et al. | 405/262 |
| 4,804,299 | A | | 2/1989 | Forte et al. | 405/285 |
| 4,824,293 | A | | 4/1989 | Brown et al. | 405/284 |
| 4,914,876 | A | | 4/1990 | Forsberg | 52/169.4 |
| 5,028,172 | A | | 7/1991 | Wilson et al. | 405/286 |
| 5,033,912 | A | | 7/1991 | Vidal | 405/262 |
| 5,091,247 | A | | 2/1992 | Willibey et al. | 428/255 |
| 5,131,791 | A | | 7/1992 | Kitziller | 405/286 |
| 5,145,288 | A | | 9/1992 | Borcherdt | 405/284 |
| 5,156,496 | A | | 10/1992 | Vidal et al. | 405/262 |
| 5,163,261 | A | | 11/1992 | O'Neill | 52/610 |
| 5,277,520 | A | | 1/1994 | Travis | 405/128 |
| 5,417,523 | A | | 5/1995 | Scales | 405/284 |
| 5,419,092 | A | | 5/1995 | Jaecklin | 52/562 |
| 5,511,910 | A | * | 4/1996 | Scales | 405/262 |
| 5,595,460 | A | | 1/1997 | Miller et al. | 405/284 |
| 5,607,262 | A | * | 3/1997 | Martin | 405/284 |
| 5,788,420 | A | | 8/1998 | Scales | 405/262 |
| 5,800,095 | A | | 9/1998 | Egan | 405/262 |
| 5,800,097 | A | * | 9/1998 | Martin | 405/284 |
| 5,816,749 | A | | 10/1998 | Bailey, II | 405/286 |
| 5,839,855 | A | * | 11/1998 | Anderson et al. | 405/262 |
| 5,934,838 | A | * | 8/1999 | Egan | 405/262 |
| 5,975,809 | A | * | 11/1999 | Taylor et al. | 405/262 |
| 6,019,550 | A | | 2/2000 | Wrigley et al. | 405/262 |
| 6,224,295 | B1 | * | 5/2001 | Price et al. | 405/262 |

OTHER PUBLICATIONS

Designing with Geosynthetics, Koerner, Robert M., Prentice–Hall, Inc., Englewood Cliffs, NJ 07632, 3rd ed.—p. 37–42;192–199; 328–351.
Safe slope reinforcement and stable embankment construction (undated).

* cited by examiner

*Primary Examiner*—Heather Shackelford
*Assistant Examiner*—Frederick L. Lagman
(74) *Attorney, Agent, or Firm*—Baker, Donelson, Bearman & Caldwell

(57) ABSTRACT

A mechanically stabilized earth retaining wall, made of at least two stacked tiers of blocks placed side-by-side. Each block defines a channel extending between opposing sides with at least two adjacent bearing surfaces and an opening between the bearing surfaces to a slot extending laterally from the channel to a back side of the block. An elongate clamping bar conforming in cross-sectional shape at least relative to the pair of adjacent bearing surfaces defined in the channel, is received within the channel. A reinforcement sheet wrapped around the elongate clamping bar extends through the slot laterally of the tiers of blocks. The clamping bar mechanically engages the bearing surfaces of the channel such that the tensile loading by backfill covering the reinforcement sheet is distributed across the block. A method of constructing a mechanically stabilized earth retaining wall is disclosed as well as a clamping bar and blocks useful with such methods and walls.

53 Claims, 6 Drawing Sheets

12

SELF-LOCKING CLAMP FOR ENGAGING SOIL-REINFORCING SHEET IN EARTH RETAINING WALL AND METHOD

TECHNICAL FIELD

The present invention relates to earth retaining walls. More particularly, the present invention relates to mechanically stabilized earth retaining walls secured by backfill loading to laterally extending soil reinforcement sheets independently of normal stress imposed by the mass of the blocks defining the wall.

BACKGROUND OF THE INVENTION

Mechanically stabilized earth retaining walls are construction devices used to reinforce earthen slopes, particularly where changes in elevations occur rapidly, for example, site developments with steeply rising embankments. These embankments must be secured, such as by retaining walls, against collapse or failure to protect persons and property from possible injury or damage caused by the slippage or sliding of the earthen slope.

Many designs for earth retaining walls exist today. Wall designs must account for lateral earth and water pressures, the weight of the wall, temperature and shrinkage effects, and earthquake loads. The design type known as mechanically stabilized earth retaining walls employ either metallic or polymeric tensile reinforcements in the soil mass. The tensile reinforcements extend laterally of the wall formed of a plurality of modular facing units, typically precast concrete members, blocks, or panels, stacked together. The tensile reinforcements connect the soil mass to the blocks that define the wall. The blocks create a visual vertical facing for the reinforced soil mass.

The polymeric tensile reinforcements typically used are elongated lattice-like structures often referred to as grids. These are stiff polymeric extrusions. The grids have elongated ribs which connect to transversely aligned bars thereby forming elongated apertures between the ribs.

Various connection methods are used during construction of earth retaining walls to interlock the blocks or panels with the grids. One known type of retaining wall has blocks with bores extending inwardly within the top and bottom surfaces. The bores receive dowels or pins. After a first tier of blocks has been positioned laterally along the length of the wall, the dowels are inserted into the bores of the upper surfaces of the blocks. Edge portions of the grids are placed on the tier of blocks so that each of the dowels extends through a respective one of the apertures. This connects the wall to the grid. The grid extends laterally from the blocks and is covered with back fill. A second tier of blocks is positioned with the upwardly extending dowels fitting within bores of the bottom surfaces of the blocks. The loading of backfill over the grids is distributed at the dowel-to-grid connection points. The strength of the grid-to-wall connection is generated by friction between the upper and lower block surfaces and the grid and by the linkage between the aggregate trapped by the wall and the apertures of the grid. The magnitude of these two contributing factors varies with the workmanship of the wall, normal stresses applied by the weight of the blocks above the connection, and by the quality and size of the aggregate.

Other connection devices are known. For example, my U.S. Pat. No. 5,417,523 describes a connector bar with spaced-apart keys that engage apertures in the grid that extends laterally from the wall. The connector bars are received in channels defined in the upper and lower surfaces of the blocks.

The specifications for earth retaining walls are based upon the strength of the interlocking components and the load created by the backfill. Once the desired wall height and type of ground conditions are known, the number of grids, the vertical spacing between adjacent grids, and lateral positioning of the grids is determined, dependent upon the load capacity of the interlocking components.

Heretofore, construction of such mechanically stabilized earth retaining walls has been limited to large, financially significant projects. This is due in part to the cost of the mechanical components used for construction of such earth retaining walls. To reduce costs, tensile reinforcements other than grids have been developed for use with mechanically stabilized earth retaining walls. These other tensile reinforcements are flexible reinforcement sheets, including large open grid woven lattices and small aperture woven lattices, as well as woven textile sheets. These other tensile reinforcements are significantly less expensive than extruded grids. However, when these other flexible reinforcements are used in construction of mechanically stabilized earth walls, their connection with the wall facing units has been a major technical challenge. Up to now, the flexible reinforcements are connected to the modular blocks through the block/reinforcement friction. The magnitude of the frictional force, (i.e., connection strength) depends on the overburden pressure acting on the particular reinforcement sheet under consideration. The higher the overburden pressure, the larger the connection strength. For small walls, the normal stresses that are applied by the weight of blocks are limited and the required connection strength is often difficult to meet.

Accordingly, there is a need in the art for an earth retaining wall that is stabilized independently of the normal stress imposed by the mass of the blocks in the wall. It is to such that the present invention is directed.

BRIEF SUMMARY OF THE INVENTION

The present invention meets the need in the art by providing an earth retaining wall that comprises at least two stacked tiers of blocks placed side by side. Each of the blocks defines a channel extending between opposing sides with the channel defining at least two adjacent bearing surfaces and an opening between the bearing surfaces to a slot extending laterally from the channel to an exterior side of the block. An elongate clamping bar conforming in cross-sectional shape at least relative to the pair of adjacent bearing surfaces defined in the channel, is received within the channel with an apex thereof adjacent the opening of the channel to the slot and with a portion of a reinforcement sheet wrapped around the clamping bar and the reinforcement sheet extending through the slot laterally of the tiers of blocks. The clamping bar mechanically engages the bearing surfaces of the channel such that the tensile loading carried by the reinforcement sheet is distributed across the bearing surfaces of the block.

In another aspect, the present invention provides a method of constructing an earth retaining wall, comprising the steps of:

(a) placing at least two stacked tiers of blocks side by side to define a length of a wall, each of the blocks defining a channel extending between opposing sides thereof, the channel defining at least two adjacent bearing surfaces and an opening between the bearing surfaces to a slot extending from the channel to an exterior side of the block;

(b) wrapping an edge portion of a reinforcement sheet over a clamping bar conforming in cross-sectional shape at least relative to the pair of adjacent bearing surfaces defined in the channel;

(c) sliding the wrapped clamping bar with the reinforcement sheet along the channel with a laterally extending portion of the reinforcement sheet slidingly received within the slot and extending the reinforcement sheet laterally of the wall, an apex of the clamping bar aligned with the opening of the channel to the slot; and (d) covering the portion of the reinforcement sheet lateral of the wall with backfill, whereby the clamping bar, being wrapped by the reinforcement sheet that is loaded by backfill covering the laterally extending portion of the reinforcement sheet, mechanically engages the two bearing surfaces of the channel such that the tensile loading is distributed across the block.

In another aspect, the present invention provides a connector for engaging a reinforcement sheet extending laterally of an earth retaining wall formed of tiers of side-by-side blocks which each block defines a channel extending from one side of the block to an opposing side, the channel defining at least two adjacent bearing surfaces and opening between the bearing surfaces to a slot that extends from the channel to an exterior face of the block for receiving therein a portion of the reinforcement sheet. The connector therefor comprises an elongate member conforming in cross-sectional shape at least relative to the pair of adjacent bearing surfaces defined in the channel extending through the block. The elongate member, being enwrapped with a portion of the reinforcement sheet that extends through the slot laterally of the block and covered by backfill, communicates the tensile loading from the reinforcement sheet to the block by bearing portions of the member against the bearing surfaces of the channel.

In another aspect, the present invention provides a block for constructing an earth retaining wall formed of a plurality of the blocks placed side-by-side in tiers, in which the block comprises a body defined by two opposing sides, a top and an opposing bottom, and a front face and an opposing back face, the body defining a channel that extends between the opposing sides for receiving a clamping bar therein with the channel defining at least two adjacent bearing surfaces for engaging surfaces of the clamping bar and an opening between the bearing surfaces to a slot that extends from the channel to an exterior face of the block for receiving therein a portion of a reinforcement sheet. The clamping bar, being wrapped with a portion of the reinforcement sheet that extends laterally of the block through the slot and being received within the channel, bears against the bearing surfaces to transfer tensile loading from the reinforcement sheet to the block.

Objects, advantages and features of the present invention will become apparent from a reading of the following detailed description of the invention and claims in view of the appended drawings.

DETAILED DESCRIPTION OF THE PREFERRED EMBODIMENTS

Figure 1:
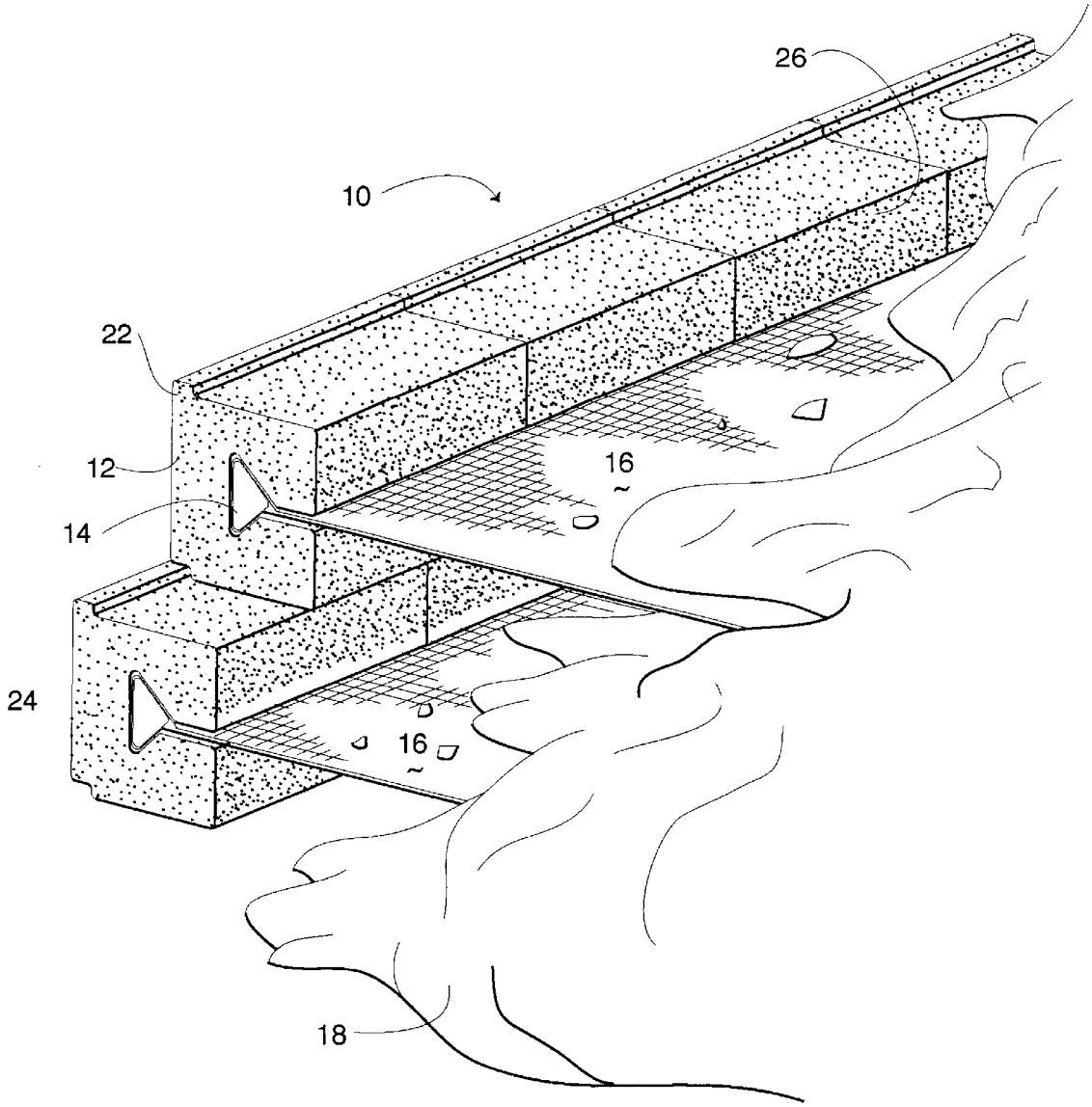
FIG. 1 illustrates a perspective cut-away view of an earth retaining wall according to the present invention.

Referring now in more detail to the drawings in which like parts have like identifiers, FIG. 1 is a perspective view of a mechanically stabilized earth retaining wall 10 according to the present invention. The wall 10 comprises a plurality of stacked, interconnected blocks 12 which receive connectors or clamping bars 14 that engage reinforcement sheets 16. As discussed below the clamping bars 14 extend through aligned channels in the blocks 12. The reinforcement sheets 16 extend laterally of the wall 10 into backfill 18 at selected vertical intervals. The reinforcement sheets 16 engage the backfill 18. The clamping bars 14 communicate the tensile loading on the reinforcement sheets 16 to the wall 10.

The wall 10 comprises at least two tiers 20, 22 of the blocks 12. Two reinforcement sheets 16 are illustrated extending laterally from the wall 10. The blocks 12 define a front face 24 for the wall 10. The blocks 12 in each tier 22, 24 are placed side-by-side to form the elongated retaining wall 10. Soil, gravel, or other backfill material 18 is placed on an interior side 26 of the wall 10.

Figure 2:
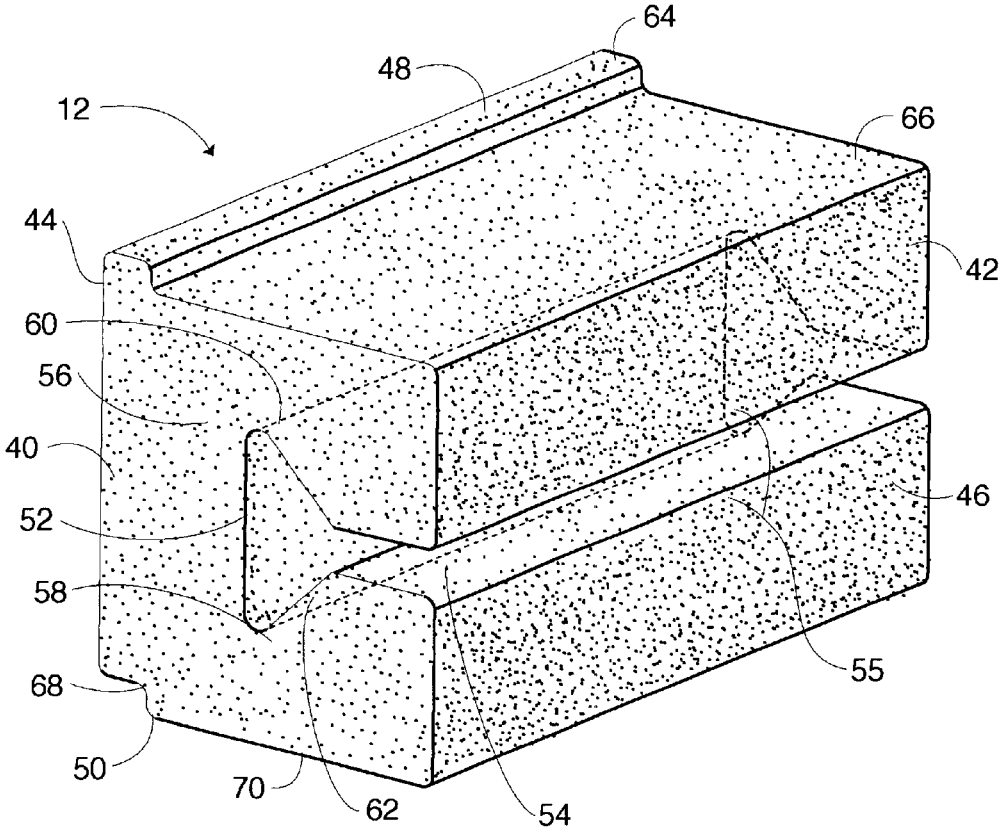
FIG. 2 illustrates in perspective view a block according to the present invention for constructing an earth retaining wall as illustrated in FIG. 1.

With reference to the perspective view in FIG. 2, each of the blocks 12 are defined by opposing side walls 40, 42, opposing front face 44 and back face 46, and opposing top and bottom sides 48, 50. The block 12 defines a channel 52 extending between the opposing sides 40, 42. In a preferred embodiment, the channel 52 defines a triangular shape in cross-sectional view. In a preferred embodiment, the triangular channel 52 is substantially equilateral. The channel 52 opens to a slot 54 that extends laterally from the channel to the back side 46 of the block 12. The slot 54 preferably defines opposed tapered edges 55 in the back face 46. In the illustrated embodiment, the channel 52 has a base wall 56 which is substantially parallel to the front face 44. In this embodiment, the slot 54 preferably opens to the channel at or near an apex. The channel 52 defines a pair of bearing surfaces 58, 60, for a purpose discussed below. The opening to the slot 54 is preferably between the two bearing surfaces 58, 60.

The blocks 12 are preferably pre-cast concrete. As is conventional with blocks or panels for earth retaining walls, the illustrated embodiment of the block 12 includes matingly conformable top and bottom surfaces 48, 50. In the illustrated embodiment, the top surface defines a raised portion 64 and a recessed portion 66. The opposing bottom 50 likewise defines a recess portion 68 and an extended portion 70. The recess portion 66 in the top 48 opposes the extended portion 70 in the bottom 50. The raised portion 64 opposes the recess portion 68. When blocks 12 are stacked in tiers 20, 22, the recessed portion 66 of blocks in the lower tier 20 receive the respective extended portion 70 of the blocks 12 in the upper tier 22. Similarly, the raised portions 64 in the lower tier 20 are received in the respective recesses 68 of the upper tier 22. In this way, the blocks 12 in vertically adjacent tiers 20, 22 are matingly engaged.

Figure 3:
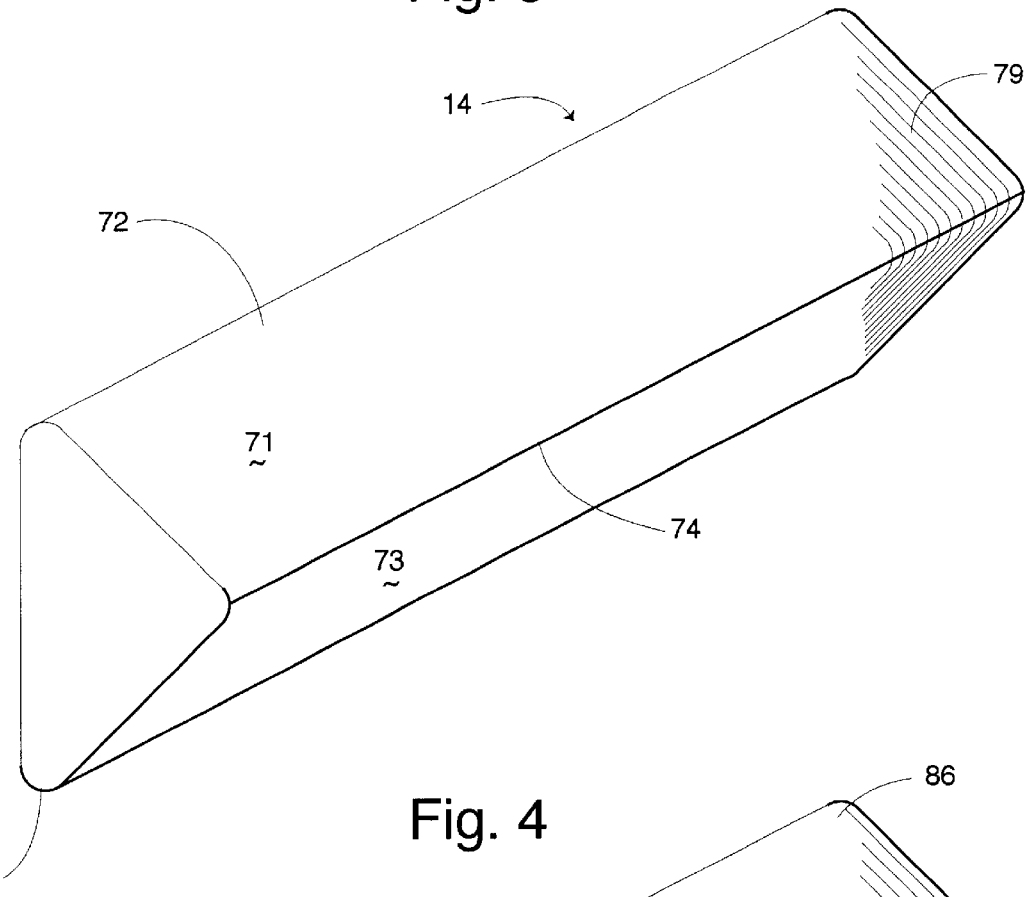
FIG. 3 illustrates in perspective view an embodiment of a clamping bar according to the present invention for constructing an earth retaining wall illustrated in FIG. 1.

FIG. 3 is a perspective view of an embodiment of the clamping bar 14 according to the present invention. The clamping bar 14 is received in the channel 52 of the block 12, as discussed below, for communicating the tensile loading from the reinforcement sheet 16 to the wall 10. In cross-sectional view, the clamping bar 14 defines a triangular shape for conformingly being received within the channel 56. Two surfaces 71, 73 conform to the bearing surfaces 58, 60 of the block 12. In a preferred embodiment, the clamping bar 14 defines an equilateral triangle to facilitate installation in the channels 56. In this embodiment, the orientation of the clamping bar 14 does not need to be evaluated during installation, thereby saving time. The clamping bar 14 defines three apexes 72, 74 and 76. In the illustrated embodiment, the apexes 72, 74, and 76 define radiused ends. For example, the clamping bar 14 in one embodiment has a length of twelve inches, and equilateral sides of approximately 1.5 inches reduced slightly to accommodate the apex radiuses of 0.1094 inches. In one embodiment, an exterior surface of the clamping bar 14 has texturing generally 79, such as spaced-apart grooves and ridges, cross-hatching, roughened projections and recessed areas and the like, for a purpose discussed below. The clamping bar 14 is preferably formed of a high strength flexible material, such as rubber or plastic such as a flexible PVC.

Figure 4:
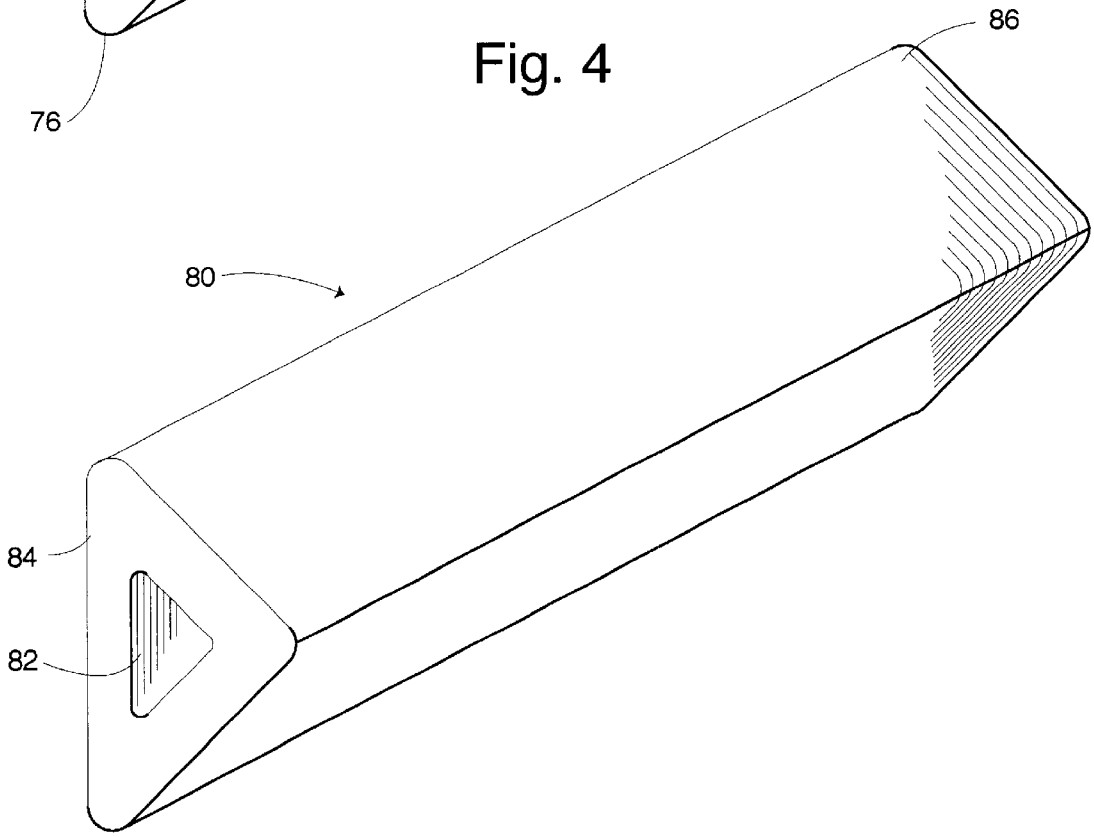
FIG. 4 illustrates in perspective view an alternate embodiment of the clamping bar illustrated in FIG. 3.

FIG. 4 is a perspective view of an alternate embodiment of a connector bar 80. In this embodiment, the connector bar 80 defines a cavity 82 extending between opposing distal ends 84, 86 along a longitudinal axis. In the illustrated embodiment, the cavity 82 conforms in cross-sectional shape to the cross-sectional shape of the connector bar 80.

Figure 5:
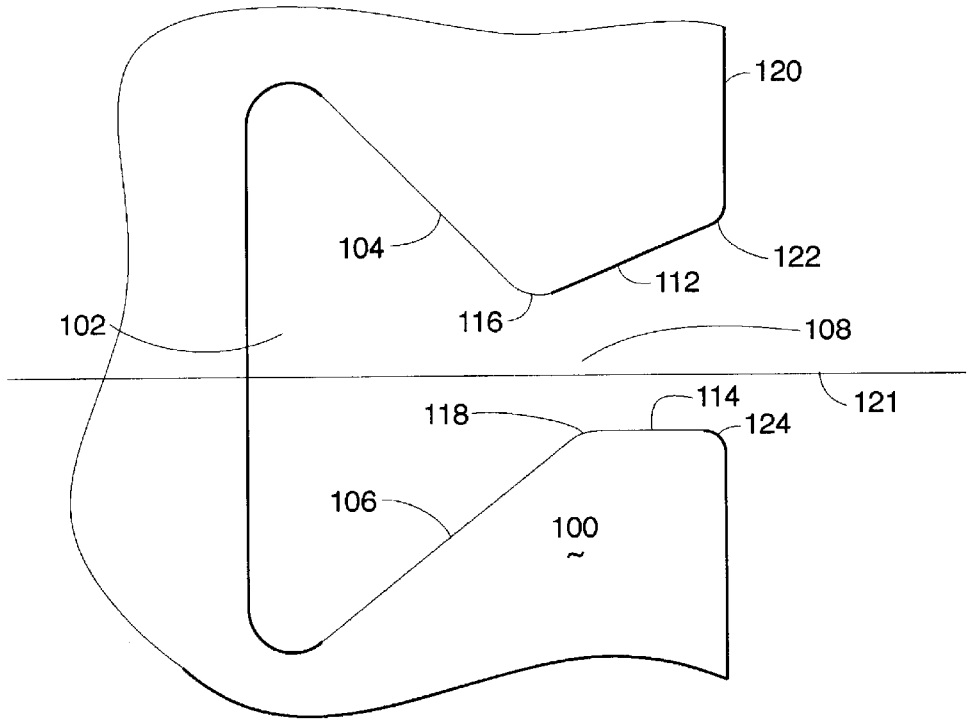
FIG. 5 illustrates a side view of an alternate embodiment of a block for constructing an earth retaining wall illustrated in FIG. 1.

FIG. 5 illustrates a side view of an alternate embodiment of a block 100 for constructing an earth retaining wall illustrated in FIG. 1. The block 100 defines a channel 102 extending between opposing sides of the block similarly to the channel 52 in the block 12 illustrated in FIG. 2. The channel 102 defines bearing surfaces 104, 106. The channel 102 opens to a slot 108 extending from a gap defined between the bearing surfaces 104, 106. The slot 108 is defined by opposing surfaces 112, 114 that extend from respective transitions 116, 118 to a back face 120. The transitions 116, 118 preferably define radiused surfaces. In the illustrated embodiment, the surface 112 extends away at an oblique angle relative to the surface 114. The transition 116 between the surfaces 104 and 112 is defined in the block deeper relative to the back face 120 than is the transition 118 between the surfaces 106 and 114. This disposes a transverse center line 121 of the channel 102 offset relative to the surfaces 112, 114 of the slot 108. The surfaces 112, 114 define tapered or radiused edges 122, 124 at the back face 120. The tapered edges of the transitions 116, 118 and the edges 122, 124 provide a smooth transition for the reinforcement sheet 16 that extends from the channel 102 and the slot 108 laterally of the block 100. To facilitate manufacture, the interior corner edges of the channel 102 are preferably radiused.

Figure 6:
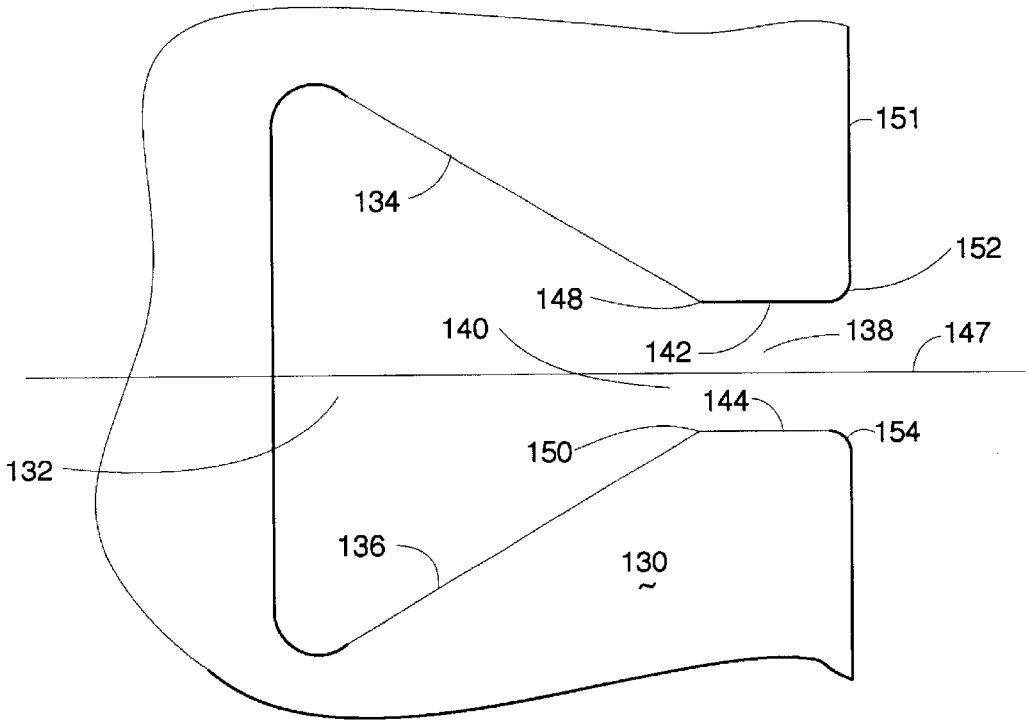
FIG. 6 illustrates a side view of an alternate embodiment of a block for constructing an earth retaining wall illustrated in FIG. 1.

FIG. 6 illustrates a side view of an alternate embodiment of a block 130 for constructing an earth retaining wall illustrated in FIG. 1. The block 130 defines a channel 132 extending between opposing sides similarly to the channel 52 in the block 12 illustrated in FIG. 2. The channel 132 defines bearing surfaces 134, 136. The channel 132 opens to a slot 138 extending from a gap 140 defined between the bearing surfaces 134, 136. The slot 138 is defined by opposing surfaces 142, 144 that extend from respective transitions 148, 150 to a back face 151. The transitions 148, 150 preferably define radiused surfaces. In the illustrated embodiment, the surface 142 is parallel to the surface 144 and equally offset from a transverse center line 147. The transitions 148 and 150 are equally deep relative to the back face 151. The surfaces 142, 144 define tapered or radiused edges 152, 154 at the back face 151. The tapered edges of the transitions 148, 150 and the edges 152, 154 provide a smooth transition for the reinforcement sheet 16 that extends from the channel 132 and the slot 138 laterally of the block 130. To facilitate manufacture, the interior corner edges of the channel 132 are preferably radiused.

Figure 7:
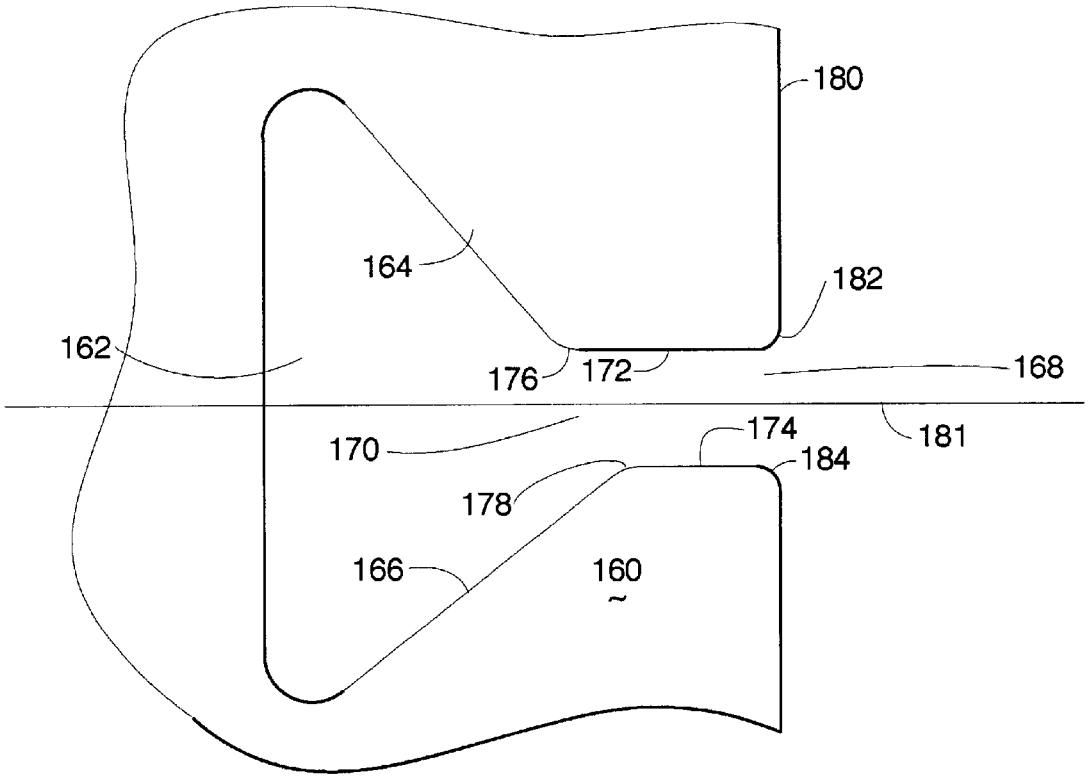
FIG. 7 illustrates a side view of an alternate embodiment of a block for constructing an earth retaining wall illustrated in FIG. 1.

FIG. 7 illustrates a side view of an alternate embodiment of a block 160 for constructing an earth retaining wall illustrated in FIG. 1. The block 160 defines a channel 162 extending between opposing sides of the block similarly to the channel 52 in the block 12 illustrated in FIG. 2. The channel 162 defines bearing surfaces 164, 166. The channel 162 opens to a slot 168 extending from a gap 170 defined between the bearing surfaces 164, 166. The slot 168 is defined by opposing surfaces 172, 174 that extend from respective transitions 176, 178 to a back face 180. The transitions 176, 178 preferably define radiused surfaces. In the illustrated embodiment, the surface 172 is parallel to the surface 174. The transition 176 between the surfaces 164 and 172 is defined in the block 160 deeper relative to the back-face 180 than is the transition 178 between the surfaces 166 and 174. A transverse center line 181 of the channel 162 is offset towards the surface 174. The surfaces 164, 166 define tapered or radiused edges 182, 184 at the back face 180. The tapered edges of the transitions 176, 178 and the edges 182, 184 provide a smooth transition for the reinforcement sheet 16 that extends from the channel 162 and the slot 168 laterally of the block 160.

The present invention provides a self-locking clamp 14 for securing laterally extending geosynthetic reinforcement sheet 16 to an earth retaining wall 10 constructed of the plurality of stacked inter-connected blocks 12. In the preferred embodiment, the reinforcement sheets 16 extend laterally from the blocks on a cross-sectional center line of the clamping bar 14. The apex of the clamping bar 14 bearingly inserts into the opening between the opposing bearing surfaces. Reinforcement sheets 16 which are not aligned with the center line tend to cause the connecting clamp to twist, which is not preferred. It is preferred that the normal loading arising from the friction between the clamping bar 14 and the bearing surfaces of the channel are equal.

Figure 8:
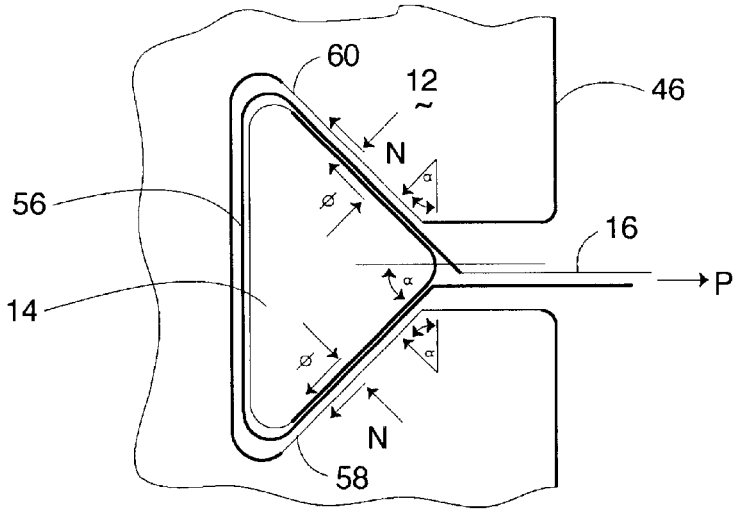
FIG. 8 illustrates a design concept for the present invention.

With reference to FIG. 8, a design for the mechanically stabilized earth retaining wall may be described as follows, where:

P is the pull-out loading for the reinforcement sheet 16, which equals the resisting force of the friction between the clamping bar 14 and the bearing surfaces 58, 60 of the block 12.

N is the normal loading between the bearing surfaces 58, 60 and the clamping bar 14.

$\alpha$ is the angle between the normal load N and a perpendicular line to the reinforcement sheet 16.

$\phi$ is the friction angle at the planar interface between the reinforcement sheet 16 and the clamping bar 14. This angle controls the self-locking attribute of the apparatus of the present invention.

The present invention is described by the following equation:

$$P=2N \sin \alpha \qquad \text{(Eq.1)}$$

The mobilized peak pull out resistance is represented by the frictional load between the reinforcement sheets 16 and the bearing surfaces 58, 60 of the channel and between the reinforcement sheets 16 and the clamping bar 14. The tensile loading on the reinforcement sheets accordingly is resisted by four surfaces of frictional loading. This is represented by the following equation:

$$P=4N \tan \phi \qquad \text{(Eq.2),}$$

Combining equations one and two shows:

$$2N \sin \alpha = 4N \tan \phi \quad \text{(Eq. 3)}$$

$$\sin \alpha = 2 \tan \phi, \quad \text{(Eq. 4)}$$

Generally, higher values of the angle of $\phi$ provide increased self-locking capability of the clamping bars 14.

For example, assume that $\alpha$ equals 30°. In order to have a reinforcement sheet 16 fully locked in the block by the clamping bar 14, $$\phi > \text{arc tan } (\sin 30°/2),$$

or $$\text{arc tan } (0.5/2).$$

Accordingly, $\phi > 14°$.

It is noted that the friction angle $\phi$ between a clamping bar 14 and a reinforcement sheet 16 is likely greater than the computed 14°, and thereby achieving the self-lock pull-out resistance of the present invention. In the event that sliding failure mode occurs, the angle of $\alpha$ can be reduced, and thus a smaller $\phi$ will meet the requirements for self-lock securing of the reinforcement sheets 16 to the block 12 by the clamping bar 14.

With reference to FIG. 1, the mechanically stabilized earth retaining wall 10 is assembled by placing a plurality of blocks 12 in the tiers 20, 22. A reinforcement sheet 16 is wrapped around one of the clamping bars 14. The clamping bar 14 with the wrapped reinforcement sheet then is slidably inserted into the aligned channels 52 of the blocks 12 in a particular tier. The reinforcement sheet is slidably moved through the slot 54 and extended laterally of the backface 46 of the blocks 12 that define the wall 10. In preferred embodiment, a side portion of the reinforcement sheet 16 is wrapped around the clamping bar 14 such that a side edge extends outwardly of the block through the slot. Backfill 18 covers the laterally extending reinforcement sheet 16. The tensile loading on the reinforcement sheet 16 impels the clamping bar 14 to wedgingly engage the opening between the bearing surfaces of the channel 52. This locks the reinforcement sheet 16 in place together with the clamping bar 14.

Additional tiers of blocks 12 are placed in the wall with connector bars 14 engaging reinforcement sheets 16 at selected vertical intervals. Backfill 18 is poured over the laterally extending reinforcement sheets 16 in order to load the clamping bars 14 into bearing engagement with the bearing surfaces of the blocks. The clamping bars 14 distribute the tensile loading from the reinforcement sheets 16 to the blocks 12. Construction of the wall continues until appropriate tiers and reinforcement sheets are connected together until the design height of the wall is reached.

Similarly, the blocks 100, 130, and 160 are gainfully used with mechanically stabilized walls 10 as discussed above. The bearing surfaces 104, 106 and 134, 136 and 164, 166 in the respective blocks 100, 130, and 160, engage the bearing surfaces 71, 73 of the clamping bar 14 for distributing the tensile loading from the backfill 18 communicated through the reinforcement sheets 16 independent of normal stress from the mass of the blocks 12 in the wall 10.

Figure 9:
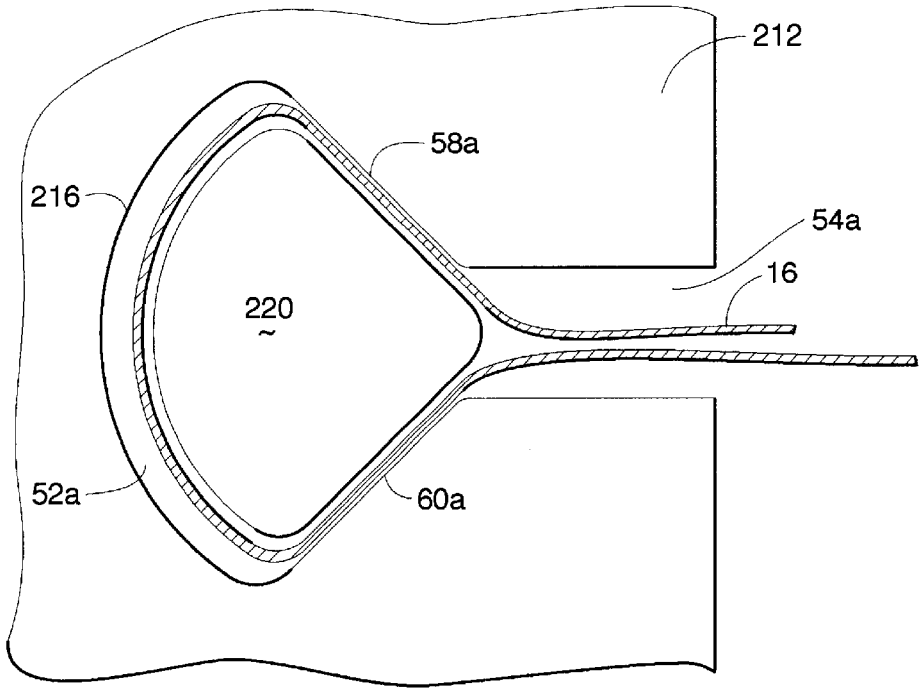
FIGS. 9 and 10 illustrate cross-sectional views of alternate embodiments of blocks defining channels useful with the present invention.
Figure 10:
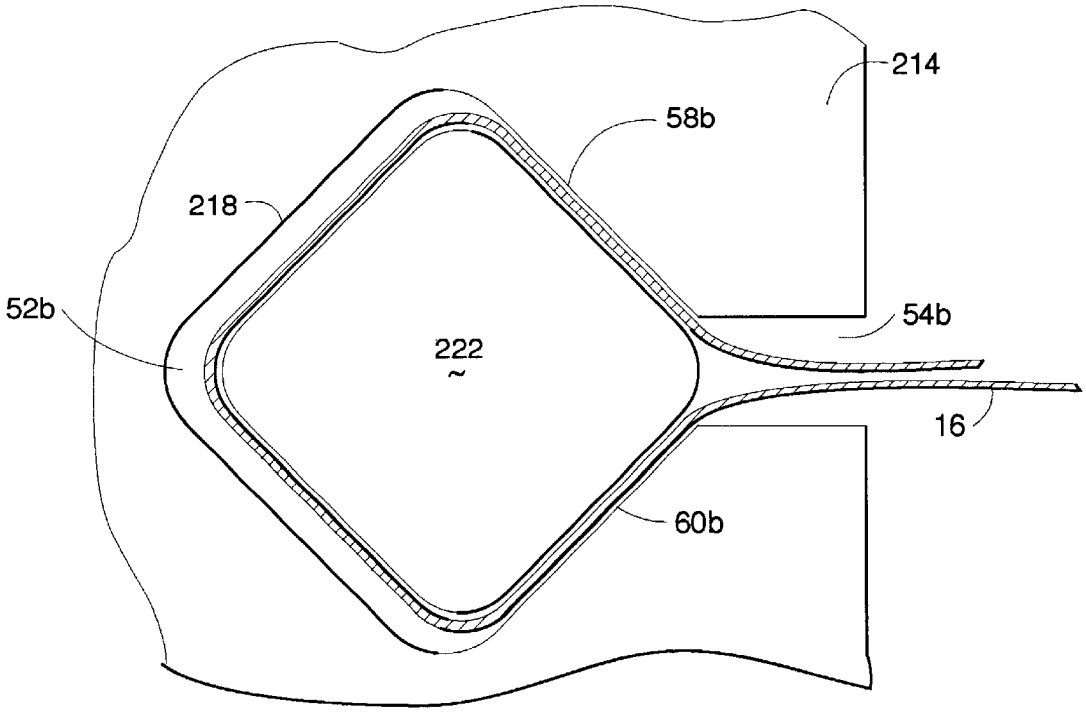

The channel 52 defines the pair of bearing surfaces 58, 60 for providing intimate bearing contact with a portion of the reinforcement sheet 16 backed by the respective bearing surfaces 71, 73 of the clamping bar 14. FIGS. 9 and 10 illustrate alternate embodiments of the blocks 212, 214. The channels 52*a* and 52*b* of the blocks 212, 214 define non-linear configurations generally 216, 218 respectively in cross-sectional view. The channels 52*a* and 52*b* receive clamping bars 220, 222 which conform substantially in cross-section to that of the channel. These provide additional surface friction contact between the reinforcement sheet 16 and the clamping bar across channel surfaces opposing the slots 54*a*, 54*b*. Particularly, however, the bearing surfaces of the clamping bars 220, 222 substantially conform to the bearing surfaces of the channel. The planar faces of the respective bearing surfaces 58*a*, 58*b*, 60*a*, 60*b* are of a relatively smooth texture (i.e. without extreme projections therefrom) such as is commonly found in conventional cast cement blocks.

It is thus seen that the present invention as disclosed herein provides mechanically stabilized earth retaining walls with reinforcement sheets secured independently of mass normal stress loading by the blocks that define the wall, together with methods therefor, stackable blocks, and clamping bars, useful in practicing the present invention, whereby the bearing surfaces bear tensile loading communicated by the clamping bar forced against the bearing surfaces by the reinforcement sheet covered with backfill.

While this invention has been described in detail with particular reference to the preferred embodiments thereof, the principles and modes of operation of the present invention have been described in the foregoing specification. The invention is not to be construed as limited to the particular forms disclosed because these are regarded as illustrative rather than restrictive. Moreover, modifications, variations and changes may be made by those skilled in the art without departure from the spirit and scope of the invention as described by the following claims.

What is claimed is:

1. An earth retaining wall, comprising:

at least two stacked tiers of blocks placed side by side, each of the blocks defining a channel extending between opposing sides, the channel defining at least two adjacent bearing surfaces and an opening between the bearing surfaces to a slot extending laterally from the channel to an exterior of the block;

an elongate clamping bar conforming in cross-sectional shape at least relative to the pair of adjacent bearing surfaces defined in the channel, received within the channel with an apex thereof adjacent the opening of the channel to the slot; and a reinforcement sheet wrapped around the clamping bar and extending through the slot laterally of the tiers of blocks, whereby the clamping bar, being wrapped by a portion of the reinforcement sheet and received in the channel with the reinforcement sheet extending laterally through the slot away from the blocks and loaded by backfill covering the reinforcement sheet, mechanically engages the bearing surfaces of the channel to distribute the tensile loading across the block.

2. The earth retaining wall as recited in claim 1, wherein the channel defines a triangular shape in cross-sectional view.

3. The earth retaining wall as recited in claim 2, wherein the clamping bar defines a triangular shape in cross-sectional view.

4. The earth retaining wall as recited in claim 3, wherein the clamping bar defines a second channel extending along a longitudinal axis thereof.

5. The earth retaining wall as recited in claim 3, wherein the slot in the back side of the block defines arcuately tapered edge surfaces between the slot and the back side.

6. The earth retaining wall as recited in claim 3, wherein the slot opens to the channel at an apex thereof.

7. The earth retaining wall as recited in claim 3, wherein the clamping bar defines textured exterior surfaces.

8. The earth retaining wall as recited in claim 1, wherein the channel and the clamping bar define an equilateral triangle in cross-sectional view.

9. The earth retaining wall as recited in claim 8, wherein the clamping bar defines a second channel extending along a longitudinal axis thereof.

10. The earth retaining wall as recited in claim 8, wherein the slot in the back side of the block defines arcuately tapered edge surfaces between the slot and the back side.

11. The earth retaining wall as recited in claim 8, wherein the slot opens to the channel at an apex thereof.

12. The earth retaining wall as recited in claim 8, wherein the clamping bar defines textured exterior surfaces.

13. The earth retaining wall as recited in claim 1, wherein the slot in the back side of the block defines arcuately tapered edge surfaces between the slot and the back side.

14. The earth retaining wall as recited in claim 1, wherein the channel is defined within the block such that a base surface of the channel is substantially parallel to a plane defined by the back surface of the block.

15. The earth retaining wall as recited in claim 1, wherein the slot opens to the channel at an apex thereof.

16. The earth retaining wall as recited in claim 1, wherein the clamping bar defines textured exterior surfaces.

17. The earth retaining wall as recited in claim 1, wherein opposing upper and lower surfaces of the blocks define opposed mating surfaces for interlocking adjacent tiers of blocks.

18. The earth retaining wall as recited in claim 1, wherein the clamping bar defines a second channel extending along a longitudinal axis thereof.

19. An earth retaining wall, comprising:

at least two stacked tiers of blocks placed side by side, each of the blocks defining a channel having a triangular shape in cross-sectional view extending between opposing sides, the channel open to a slot extending laterally from the channel to an exterior of the block;

an elongate clamping bar having a triangular shape in cross-sectional view, conformingly received within the channel with an apex thereof adjacent the opening of the channel to the slot; and a reinforcement sheet wrapped around the clamping bar and extending through the slot laterally of the tiers of blocks, whereby the clamping bar, being wrapped by a portion of the reinforcement sheet that extends through the slot laterally of the wall and loaded by backfill covering the reinforcement sheet, mechanically engages the bearing surfaces of the channel such that the tensile loading is distributed across the block.

20. The earth retaining wall as recited in claim 19, wherein the clamping bar defines a second channel extending along a longitudinal axis thereof.

21. The earth retaining wall as recited in claim 19, wherein the slot in the back side of the block defines arcuately tapered edge surfaces between the slot and the back side.

22. The earth retaining wall as recited in claim 19, wherein the slot opens to the channel at an apex thereof.

23. The earth retaining wall as recited in claim 19, wherein the clamping bar defines textured exterior surfaces.

24. The earth retaining wall as recited in claim 19, wherein the clamping bar defines an equilateral triangle in cross-sectional view.

25. The earth retaining wall as recited in claim 19, wherein the slot in the back side of the block define arcuately tapered edge surfaces between the slot and the back side.

26. The earth retaining wall as recited in claim 19, wherein the channel is defined within the block such that a base surface of the channel is substantially parallel to plane defined by the back surface of the block.

27. The earth retaining wall as recited in claim 19, wherein opposing upper and lower surfaces of the blocks define opposed mating surfaces for interlocking adjacent tiers of blocks.

28. A method of constructing an earth retaining wall, comprising the steps of:

(a) placing at least two stacked tiers of blocks side by side to define a length of a wall, each of the blocks defining a channel extending between opposing sides thereof, the channel defining at least two adjacent bearing surfaces and opening between the bearing surfaces to a slot extending laterally from the channel to an exterior of the block;

(b) wrapping an edge portion of a reinforcement sheet over a clamping bar conforming in cross-sectional shape at least relative to the pair of adjacent bearing surfaces defined in the channel;

(c) sliding the wrapped clamping bar with the reinforcement sheet along the channel with a laterally extending portion of the reinforcement sheet slidingly received within the slot and extending the reinforcement sheet laterally of the wall; and (d) covering the portion of the reinforcement sheet lateral of the wall with backfill, whereby the clamping bar, being wrapped by the reinforcement sheet that is loaded by backfill covering the laterally extending portion of the reinforcement sheet, mechanically engages the two bearing surfaces of the channel such that the tensile loading on the connector bar is distributed across the block.

29. The method as recited in claim 28, further comprising the step of providing each block with opposing upper and lower surfaces with matingly engageable features for interlocking adjacent tiers of blocks.

30. The method as recited in claim 28, wherein a first distal edge of the reinforcement sheet is adjacent an apex of the connector bar.

31. The method as recited in claim 28, further comprising the step of providing a textured exterior surface to the clamping bar.

32. A method of constructing an earth retaining wall, comprising the steps of:

(a) placing at least two stacked tiers of blocks side by side to define a length of a wall, each of the blocks defining a channel having a triangular shape in cross-sectional view extending between opposing sides thereof and defining a pair of bearing surfaces, the channel opening between the pair of bearing surfaces to a slot extending laterally from the channel to an exterior of the block;

(b) wrapping an edge portion of a reinforcement sheet over a clamping bar that defines a triangular shape in cross-sectional view;

(c) sliding the wrapped clamping bar with the reinforcement sheet along the channel with a laterally extending portion of the reinforcement sheet slidingly received within the slot and extending laterally of the wall; and (d) covering the portion of the reinforcement sheet lateral of the wall with backfill, whereby the clamping bar, being wrapped by the reinforcement sheet that is loaded by the backfill, mechanically engages the two bearing surfaces of the channel such that the tensile loading is distributed across the block.

33. The method as recited in claim 32, further comprising the step of providing each block with opposing upper and lower surfaces with matingly engageable features for interlocking adjacent tiers of blocks.

34. The method as recited in claim 32, wherein a first distal edge of the reinforcement sheet is adjacent a first one of the apexes of the bar.

35. The method as recited in claim 32, further comprising the step of providing a textured exterior surface to the clamping bar.

36. A connector for clamping a reinforcement sheet extending laterally of an earth retaining wall formed of tiers of side-by-side blocks where each block defines a channel extending from one side of the block to an opposing side, the channel defining at least two adjacent bearing surfaces and an opening between the bearing surfaces to a slot that extends from the channel to an exterior of the block for receiving therein a portion of the reinforcement sheet, comprising:

an elongate member conforming in cross-sectional shape at least relative to a pair of adjacent bearing surfaces defined in a channel extending through a block, whereby the elongate member, being wrapped with a portion of the reinforcement sheet that extends through a slot laterally of the block and covered by backfill, communicates the tensile loading from the reinforcement sheet to the block by forcing the member against the bearing surfaces of the channel and thereby clamping the reinforcement sheet to the block.

37. The connector as recited in claim 36, wherein the member is triangular in cross-sectional shape.

38. The connector as recited in claim 37, wherein the member in cross-sectional shape defines an equilateral triangle.

39. The connector as recited in claim 37, wherein the member defines a channel extending from a first side to an opposing side along a longitudinal axis thereof.

40. The connector as recited in claim 39, wherein the channel in the member conforms in cross-sectional shape to the cross-sectional shape of the member.

41. The connector as recited in claim 37, wherein the exterior surface of the member is textured.

42. The connector as recited in claim 36, wherein the member defines a channel extending from a first side to an opposing side along a longitudinal axis thereof.

43. The connector as recited in claim 42, wherein the channel in the member conforms in cross-sectional shape to the cross-sectional shape of the member.

44. The connector as recited in claim 36, wherein the exterior surface of the member is textured.

45. A connector for clamping a reinforcement sheet extending laterally of an earth retaining wall formed of tiers of side-by-side blocks which each block defines a channel having a triangular shape in cross-sectional view extending from one side of the block to an opposing side, the channel defining at least two adjacent bearing surfaces and an opening at a common apex of the bearing surfaces to a slot that extends from the channel to an exterior of the block for receiving therein a portion of the reinforcement sheet, comprising:

an elongate member having a triangular shape in cross-sectional view, for being conformingly received in a channel extending through a block, whereby the elongate member, being wrapped with a portion of the reinforcement sheet that extends through the slot laterally of the block and covered by backfill, communicates the tensile loading from the reinforcement sheet to the block by forcing portions of the member against the bearing surfaces of the channel and thereby clamping the reinforcement sheet to the block.

46. The connector as recited in claim 45, wherein the member in cross-sectional shape defines an equilateral triangle.

47. The connector as recited in claim 45, wherein the member defines a channel extending from a first side to an opposing side along a longitudinal axis thereof.

48. The connector as recited in claim 47, wherein the channel in the member conforms in cross-sectional shape to the cross-sectional shape of the member.

49. The connector as recited in claim 45, wherein the exterior surface of the member is textured.

50. A block for constructing an earth retaining wall formed of a plurality of the blocks placed side-by-side in tiers, comprising:

a body defined by two opposing sides, a top and an opposing bottom, and a front face and an opposing back face, the body defining a channel having a triangular shape in cross-sectional view which extends between the opposing sides for receiving a clamping bar therein which defines a shape conforming to the channel with two of the surfaces of the channel defining bearing surfaces for engaging surfaces of the clamping bar and an opening between the bearing surfaces to a slot that extends from the channel to an exterior of the block for receiving therein a portion of a reinforcement sheet, whereby the block, receiving the clamping bar wrapped with a portion of the reinforcement sheet that extends laterally of the block through the slot, bears tensile loading from the backfill covering the reinforcement sheet communicated by the clamping bar against the bearing surfaces of the block.

51. The block as recited in claim 50, wherein the slot at the back face of the block defines arcuately tapered edge surfaces between the slot and the back face.

52. The block as recited in claim 50, wherein the slot at the back face of the block defines arcuately tapered edge surfaces between the slot and the back face.

53. The block as recited in claim 50, wherein the slot at the back face of the block defines arcuately tapered edge surfaces between the slot and the back face.

* * * * *